United States Patent [19]

Leiter

[11] Patent Number: 4,496,059

[45] Date of Patent: Jan. 29, 1985

[54] CURTAIN BOW

[76] Inventor: Raymond J. Leiter, 134 Long Meadow Dr., Rochester, N.Y. 14621

[21] Appl. No.: 253,613

[22] Filed: Apr. 13, 1981

[51] Int. Cl.[3] ..... A47H 1/02

[52] U.S. Cl. ..... 211/105.1; 5/505

[58] Field of Search ..... 211/105.1, 87, 123; 5/494, 504, 505, 506; 160/352; 248/262

[56] References Cited

U.S. PATENT DOCUMENTS

| | | | |
|---|---|---|---|
| 1,257,332 | 2/1918 | Erlandson | 5/505 |
| 1,732,716 | 10/1929 | Ealy | 5/505 |
| 2,210,255 | 8/1940 | Peevey | 5/505 |
| 2,261,142 | 11/1941 | Davis | 160/352 X |
| 2,572,797 | 10/1951 | Zimmer | 211/87 |
| 2,614,269 | 10/1952 | Hougham | 5/505 |
| 2,974,328 | 3/1961 | Hebberd | 5/505 |
| 3,050,747 | 8/1962 | Uhl | 5/505 |

*Primary Examiner*—William E. Lyddane
*Assistant Examiner*—Peter A. Aschenbrenn

[57] ABSTRACT

A curtain bow 15 is used to displace a curtain 10 from its usual position for a variety of purposes. Bow 15 is formed of a longitudinally compression resistant material flexible enough to be bowed between a pair of end supports 16 spaced apart by less than the length of the bow. End supports 16 hold the ends of bow 15 from turning and dispose the blow in a plane approximately midway between horizontal and vertical to displace curtain 10 in a desired direction from its gravitationally assumed position.

5 Claims, 4 Drawing Figures

CURTAIN BOW

BACKGROUND

I have recognized a need for a curtain bow to displace a curtain from a position it would otherwise gravitationally assume to insure space on one side of the curtain or keep it from moving in one direction. This can be useful for holding a window curtain away from a window to make room for plants, holding a shower curtain out to enlarge a shower space, holding a construction curtain or tent wall against wind blowing it inward, and many similar purposes. I have also recognized a simple, effective, and low cost way of meeting this need with a curtain bow that is inexpensive and easy to install, mount, and dismount.

SUMMARY OF THE INVENTION

My inventive curtain bow displaces a curtain from its gravitationally assumed position to provide additional space or prevent movement of the curtain. The bow is made of longitudinally compression resistant material flexible enough to be bowed between a pair of end supports. The end supports are spaced apart by less than the length of the bow and hold the bow ends against turning. The bow is disposed in a plane approximately midway between horizontal and vertical where it can reliably hold its position against a displaced curtain.

DRAWINGS

DETAILED DESCRIPTION

Figure 1:
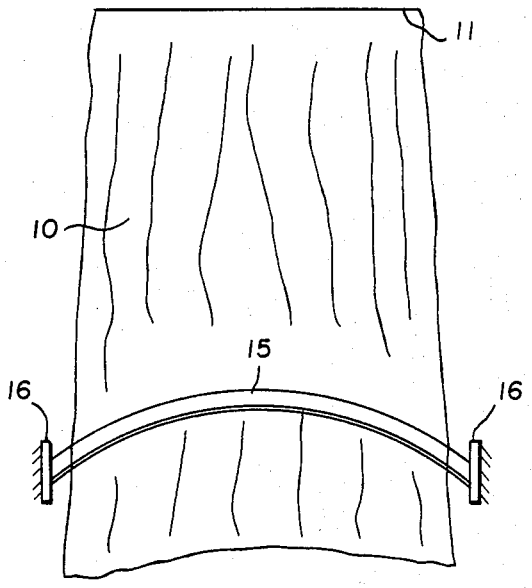
FIG. 1 is a partially schematic front elevational view of a preferred embodiment of my curtain bow holding a translucent curtain.

My preferred embodiment of curtain bow 15 as illustrated in the drawings displaces a translucent curtain 10 supported along a top line 11. Curtain 10 can have many forms and purposes, and curtain bow 15 can be used under any circumstance making it desirable to displace a curtain to one side of its hanging line.

Bow 15 is formed of a longitudinally compression resistant material that is flexible enough to be bowed as illustrated. Many materials including wood, metal, and resin can meet this qualification; and bow 15 is preferably lightweight, low cost, flexible, and strong enough to hold its bowed position against curtain 10.

Bow 15 is held in its bowed position between a pair of end supports 16 that are spaced apart by less than the length of bow 15. Supports 16 can also have many forms and be made of many materials. They can be secured to bow 15 or to a supporting structure, and they are generally positioned at a spacing less than the length of bow 15 in a way that holds them reliably in place to support bow 15.

Figure 2:
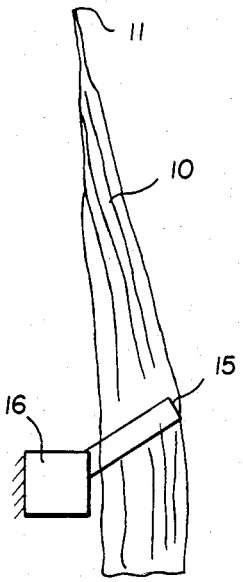
FIG. 2 is a side elevational view of the embodiment of FIG. 1.

Another function of end supports 16 is to hold the ends of bow 15 from turning so as to maintain bow 15 in a plane oriented approximately midway between horizontal and vertical as best shown in FIG. 2. End supports 16 can do this by having a non-rotational engagement with the ends of bow 15 and with a fixed structure adjacent the ends of bow 15.

The inclination of bow 15 midway between horizontal and vertical is preferred for displacing curtain 10 and holding bow 15 in place. At orientations closer to horizontal, bow 15 tends to fall down; and at orientations closer to vertical, the load of displaced curtain 10 tends to push bow 15 back. At the mid-orientation between vertical and horizontal, bow 15 is stoutly propped against curtain 10 and tends to hold its position reliably.

Figure 3:
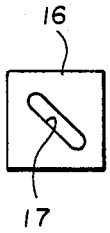
FIG. 3 is a front elevational view of an end support for the curtain bow of FIG. 1.
Figure 4:
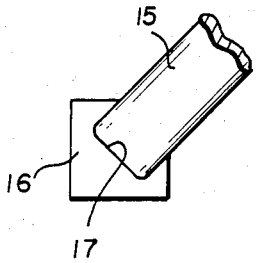
FIG. 4 is a fragmentary view of a curtain bow mounted in the end support of FIG. 3.

A simple and preferred form of end support 16 is shown in FIGS. 3 and 4 as having a longitudinal slot or recess 17 to receive a rectangular end of bow 15. A pair of supports 16 mounted in a window casing, for example, can hold the ends of bow 15 against turning and dispose bow 15 at the preferred orientation between horizontal and vertical so that bow 15 can displace curtain 10 as illustrated. Supports 16 allow quick and easy mounting and dismounting of bow 15 simply by bending bow 15 to insert or remove its ends from recesses 17.

Bow 15 can have cross-sectional shapes other than rectangular and need not have the same cross-sectional shape throughout its length, and bow 15 and end supports 16 can be configured in many ways so that the bow cannot rotate relative to its end supports. These can also be mounted in many non-rotational ways between many different support elements to hold the bow in the proper orientation for displacing a curtain.

I claim:

1. Curtain bow apparatus for use to support a curtain hanging over an opening defined between two opposing vertical walls which comprises, a pair of end supports having front faces and back faces and adapted to be attached by the back faces each to a different one of said walls with said front faces opposing and opposite to each other, each of said end supports having a socket provided by a rectangular slot disposed at an acute angle to the vertical, said slots being directly opposite to each other, a bow of rectangular cross section similar to the shape of said slots and being of longitudinally uncompressible material flexible enough to be bowed and longer than the distance between said bottom of said sockets in said end supports, the opposite ends of said bow being received in said sockets to form a curved surface at said acute angle to the vertical for holding said curtain outward from the opening while being self-supporting in said sockets.

2. The invention according to claim 1 wherein said acute angle is 45°.

3. The invention according to claim 1 wherein said end supports are rectangular in shape.

4. The invention as set forth in claim 1 wherein said supports are formed of resin material.

5. The invention as set forth in claim 4 wherein said bow is also formed of resin material.

* * * * *